US011796186B2

(12) United States Patent
Dadoyan

(10) Patent No.: US 11,796,186 B2
(45) Date of Patent: Oct. 24, 2023

(54) HEAT SHIELD

(71) Applicant: David Dadoyan, Valley Glen, CA (US)

(72) Inventor: David Dadoyan, Valley Glen, CA (US)

(73) Assignee: Sweet Heat LLC, Van Nuys, CA (US)

( * ) Notice: Subject to any disclaimer, the term of this patent is extended or adjusted under 35 U.S.C. 154(b) by 0 days.

(21) Appl. No.: 18/100,741

(22) Filed: Jan. 24, 2023

(65) Prior Publication Data

US 2023/0243518 A1 Aug. 3, 2023

Related U.S. Application Data

(62) Division of application No. 16/679,003, filed on Nov. 8, 2019.

(51) Int. Cl.
*F24C 15/22* (2006.01)
*F24C 1/12* (2021.01)

(52) U.S. Cl.
CPC ..... *F24C 15/22* (2013.01); *F24C 1/12* (2013.01)

(58) Field of Classification Search
CPC .... F24C 15/22; F24C 1/12; F24C 1/00; A45B 23/00
See application file for complete search history.

(56) References Cited

U.S. PATENT DOCUMENTS 3,885,582 A * 5/1975 Kowalski ..... A45B 23/00 135/33.7
5,964,233 A * 10/1999 Clark ..... A45B 23/00 135/92
6,298,866 B1 * 10/2001 Molnar, IV ..... A45B 23/00 108/50.13
6,336,450 B1 * 1/2002 Collet ..... F24C 15/22 135/16
6,550,470 B2 * 4/2003 Liang ..... F24C 1/12 126/277
6,745,759 B2 * 6/2004 Bossier ..... F24C 1/10 126/92 R
7,828,002 B2 * 11/2010 Boldsen ..... A45B 3/04 135/92
9,149,097 B1 * 10/2015 Davis ..... A45B 23/00
2010/0132698 A1 * 6/2010 Pedersen ..... F24C 1/12 126/92 B
2011/0073095 A1 * 3/2011 Bechtold ..... F24C 1/12 126/58
2017/0102151 A1 * 4/2017 Mushnick ..... F24C 15/22
2019/0301740 A1 * 10/2019 Daniels ..... F23C 3/002
2021/0140649 A1 * 5/2021 Dadoyan ..... F24C 15/22

* cited by examiner

*Primary Examiner* — Alfred Basichas
(74) *Attorney, Agent, or Firm* — Foundation Law Group LLP; J D Harriman

(57) ABSTRACT

Described herein is a device that will restrict the radiant heat from transferring all around a patio heater and instead will effectively focus, deflect and/or reflect radiant and convective heat from a patio heater toward a desired direction. By focusing the heat toward one direction, heat is not lost to the unoccupied direction where no persons are lounging. Rather, more of the heat is directed toward the people and thus the heater operates more efficiently.

1 Claim, 5 Drawing Sheets

HEAT SHIELD

This patent application is a divisional of, and claims priority to, U.S. patent application Ser. No. 16/679,003 filed on Nov. 8, 2019, which is incorporated by reference herein in its entirety.

BACKGROUND OF THE SYSTEM

Most heating and cooling systems are designed for indoor use. However, there are times when there is a need for outdoor heating. One type of outdoor heater is called a "patio heater". A patio heater is a radiant heating appliance for generating thermal radiation for outdoor use. There are two widely used designs for patio heaters. The most popular and common type of patio heater is typically called the mushroom or umbrella heater where heat is generated by burning liquid petroleum gas, propane, natural gas, or butane at the top of the heater. The heat is radiated downward by an overhead reflector in a circular pattern all around the heater. Another popular type of heater is commonly referred to as a vortex or pyramid flame type heater. In these heaters heat is generated by burning liquid petroleum gas, propane, natural gas, or butane at the bottom of the heater. The flame travels up through a tube at the center of the heater and the heat is radiated all around the tube to the nearby environment.

These designs are most effective when placed in the middle of the environment to be heated. The designs emit heat in a circle with the device at the center. However, there are some situations where the heater must be placed at an edge of an environment, or only on one side of where people will be located. In those conditions, the heaters are not efficient because much of the heat is emitted into unoccupied space. One solution to that problem is to use a more powerful heater so that enough heat is provided to the occupied spaces. The alternative is to have inadequate heating in the occupied area.

There have been some attempts in the prior art to solve this problem and disadvantage. One solution is to have the overhead heat shield of the mushroom style heater be tilt-able, in an attempt to induce directionality to the heat radiation. In other prior art embodiments, the neck of the heater is bendable so that the entire head unit is repositioned to induce directionality. Neither solution provides effective heat distribution. In fact, the complexity of the mechanisms adds to the cost of the heater. Also, with more moving parts, the potential for breakdown increases, shortening the useful life of the heater. In addition, there is no solution for the many existing heaters that were not originally provided with such features.

SUMMARY

Described herein is a device that will restrict the radiant heat from transferring all around a patio heater and instead will effectively focus, deflect and/or reflect radiant and convective heat from a patio heater toward a desired direction. By focusing the heat toward one direction, heat is not lost to the unoccupied direction where no persons are lounging. Rather, more of the heat is directed toward the people and thus the heater operates more efficiently.

DETAILED DESCRIPTION OF THE SYSTEM

Figure 1:
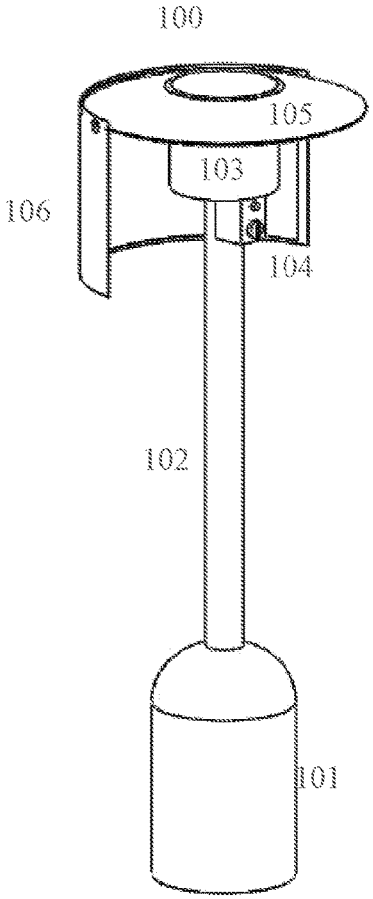
FIG. 1 illustrates a heater having a focusing device in an embodiment of the system.

The present apparatus is a directional heat shield that can be used with patio heaters to provide improved efficiency. FIG. 1 illustrates the directional heat shield as used with a patio heater in an embodiment of the system. The heater 100 comprises a base 101, shaft 102, heating unit 103, control unit 104, cap 105, and directional heat shield 106. The base 101 can be lifted by sliding it up the shaft 101 and encloses a fuel tank (e.g. propane). The fuel is fed through a line within shaft 102 to reach outlets in heating unit 103. The heater 100 is often referred to as a "mushroom" or "umbrella" heater.

Control unit 104 is used to turn the flow of fuel off and on, and to regulate the amount of fuel provided to heating unit 103. An igniter is typically part of the control unit 104 and is used to ignite the fuel in the heating unit 103 when the system is turned on. Subsequently the heat produced by the heating element 103 is controlled by regulating the flow of fuel via control unit 104.

The cap 105 is typically a reflective circular component comprised of metal and reflects heat downward from the heating unit. The directional heat shield 106 is a curved sheet of metal that is coupled to the cap 105 and extends approximately 180 degrees around the cap 105. The heat shield 106 extends below the heating unit 103. The heat shield 106 reflects heat back toward the front of the heater 100 towards the occupied area, and reduces heat loss in the rearward direction, improving the efficiency of the heater 100. Using the heat shield 106, the heater can use less fuel to produce the same amount of heat as a heater that does not use the heat shield 106.

Figure 2:
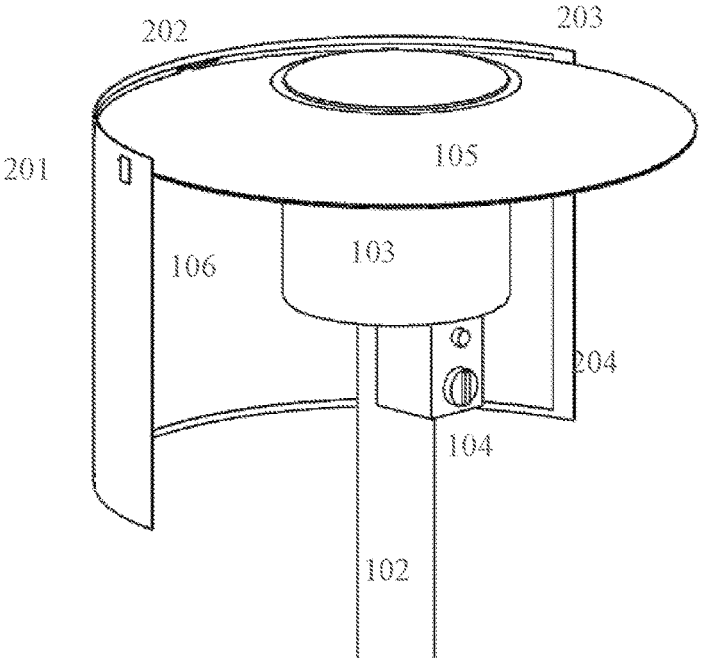
FIG. 2 illustrates a close up view of the focusing device of FIG. 1.

FIG. 2 is a detailed view of the heater 100 and heat shield 106 of FIG. 1. Like elements of FIG. 1 have the same element numbers in FIG. 2. The directional heat shield 106 is coupled to the cap 105 at several points, such as points 201, 202, and 203 in the embodiment of FIG. 2. The heat shield 106 in one embodiment has a hemmed edge 204 that provides some rigidity to the structure and makes it easier to handle during use.

The heat shield 106 may be removable coupled to the cap 105 by using any number of fastening means, including magnets, clips, clamps, adhesive, wire, and the like. In one embodiment, the heat shield 106 is comprised of a reflective metal sheet (e.g. stainless steel, polished aluminium, and the like). In one embodiment the heat shield 106 is comprised of a reflective high temperature resistant fabric with stitched edges. The fabric would include a frame around the edges to provide shape and rigidity. In one embodiment the fabric is comprised of, for example, Newtex, Z-Flex, Z-Shield, Therma-Flec, silica fabric, coated fabrics (including neoprene, silicone, ceramic, refractory, etc.) and the like.

Figure 3:
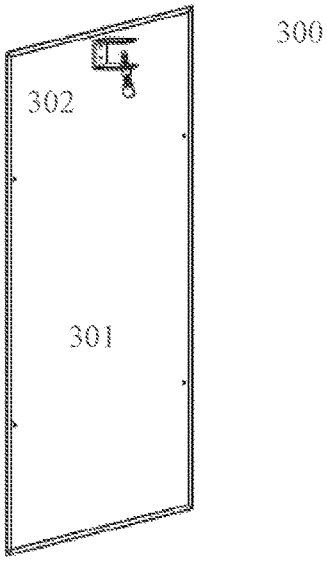
FIG. 3 illustrates a heat shield panel in an embodiment of the system.

FIG. 3 illustrates another embodiment of the apparatus for use with a mushroom style heater. The heat shield 300 comprises a sheet 301 of metal or fabric and an integrated fastener 302. In the embodiment shown, the fastener 302 is a clamp, but it could also be magnetic, adhesive, wire, a clip, and the like.

Figure 4:
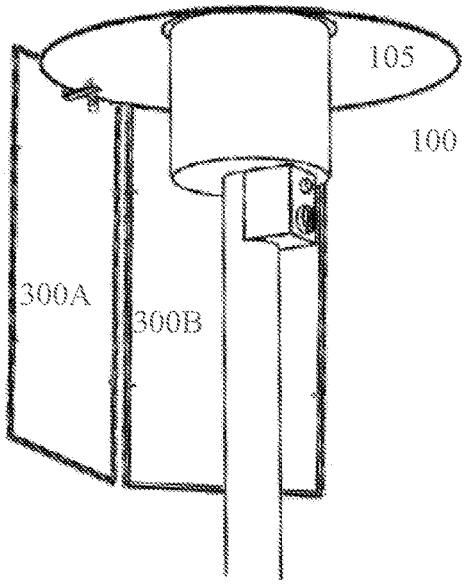
FIG. 4 illustrates the use of the heat shield of FIG. 3 in an embodiment of the system.

The operation of the embodiment of FIG. 3 is illustrated in FIG. 4. One or more heat shields such as heat shield 300A and heat shield 300B can be attached to the heater 100 at the cap 105 to provide more customized control over the heat distribution of the heater 100. Depending on the location and orientation of the heater 100, a user may desire to have more or fewer heat shields 300 to control the direction of heat radiation of the heater 100.

Figure 5:
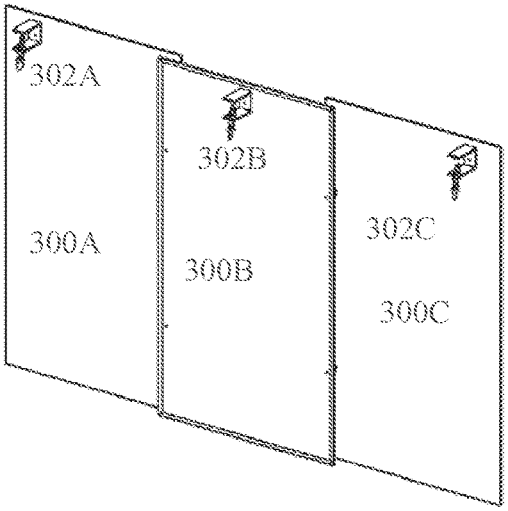
FIG. 5 illustrates an overlapping technique of the heat shield of FIG. 3 in an embodiment of the system.

FIG. 5 illustrates one technique for overlapping the panels where a center panel 300B is slightly overlapped by a first side panel 300A and a second side panel 300C. Alternatively, the right edge of panel 300B could overlap the left edge of panel 300C. Any overlapping arrangement may be made without departing from the scope and spirit of the system. The user is free to arrange the panels as desired, with one goal of preventing open spaces between the panels where heat could escape.

The fasteners 302A, 302B, and 302C may be positioned in the center of the panel or at one or the other edge as desired to make it easier to arrange the panels effectively.

Figure 6:
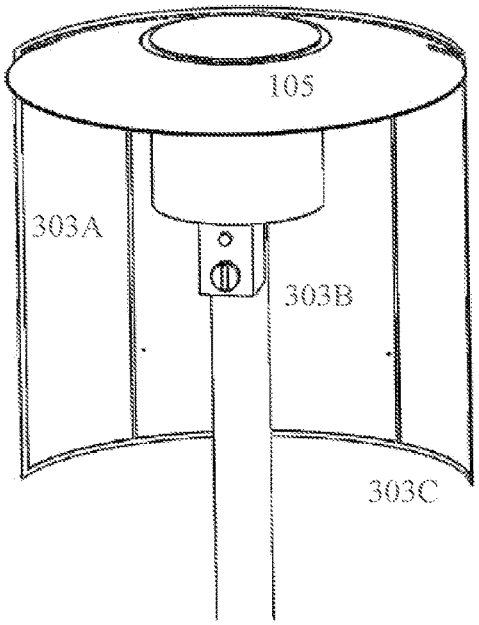
FIG. 6 illustrates the heat shield of FIG. 3 in a flexible embodiment.

The embodiment of FIGS. 3, 4, and 5 are examples of individual rigid flat panels. Alternatively, the system could use one or more flexible panels as shown in FIG. 6. The panels 303A, 303B, and 303C can be comprised of heat resistant fabric and their flexibility enables them to more closely align with the curve of cap 105. The panels could each include two or more fasteners (not shown in FIG. 6) to help shape the panels to the round edge of the cap 105. The flexible panels may be linked together using clips, rivets, eyelets, sockets and/or buttons to reduce heat loss in the gaps between the panels and have the added benefit of a smaller shipping form factor compared to a single larger flexible panel. In embodiment, the panels may be comprised of metal but curved to match the edge of the cap 105.

Figure 7:
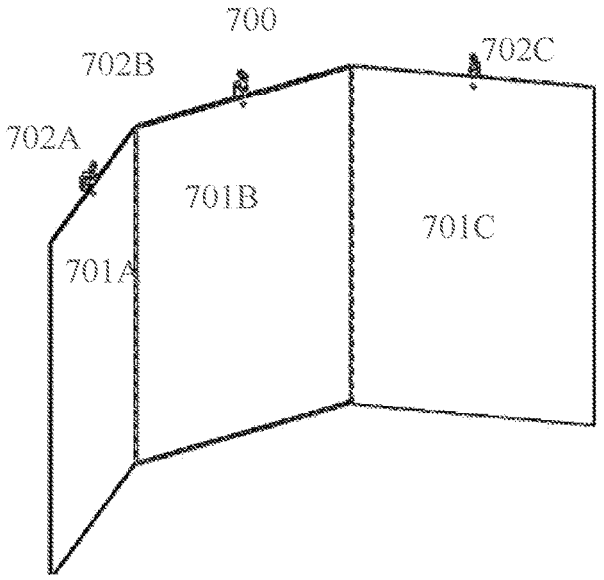
FIG. 7 illustrates a heat shield having folds in an embodiment.

FIG. 7 illustrates an embodiment of the heat shield. The directional heat shield 700 consists of a folding assembly comprised of sections 701A, 701B, and 701C. The shield 700 includes multiple fasteners 702A, 702B, and 702C to attach the shield 700 to a heater cap. The folding nature of this embodiment allows it to be shipped in a smaller package, as well as more easily stored when not in use. As noted, the fasteners may be clamps, clips, magnets, adhesive, wire, and the like. The panel 700 can be folded in threes, as shown in FIG. 7, or it could be folded in half, in fours, or any suitable configuration.

Figure 8:
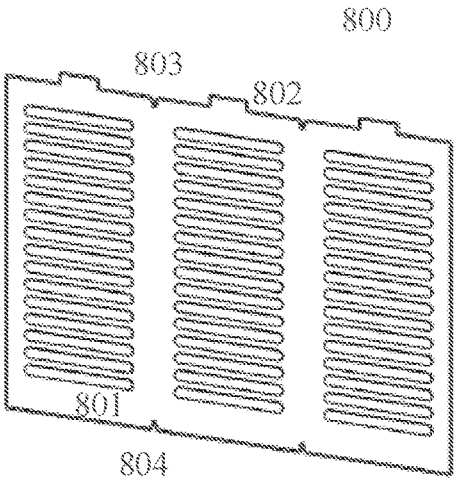
FIG. 8 illustrates a heat shield comprised of heavy duty foil in an embodiment.
Figure 9:
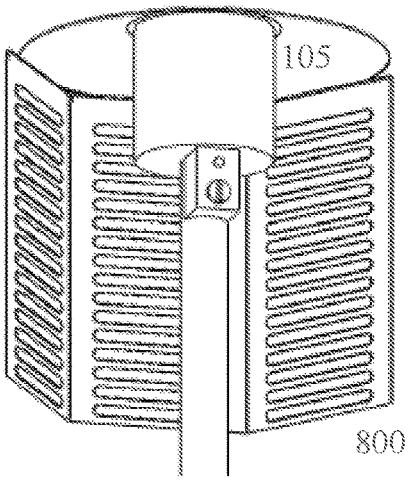
FIG. 9 illustrates the heat shield of FIG. 8 attached to a heater.

FIG. 8 illustrates an embodiment of the system comprised of heavy duty foil. The shield 800 is made of relatively rigid foil that can be bent or curved as desired. The shield 800 includes a plurality of ribbed sections 801. The ribbed sections offer more structural rigidity to the reflector panels. The ribbed sections also provide a level of insulation to the panels reducing the transfer of conductive heat toward the rear of the reflector. This is useful to keep objects directly behind the ribbed reflector cooler during use. The insulative properties are a result of the restricted flow of air that would get trapped in the ribs. The foil can be bent at the spaces between the ribbed sections, at locations defined by notches 803 and 804. Foldable tabs 802 can be used to attach the shield 800 to the cap of a heater as shown in FIG. 9.

Figure 10:
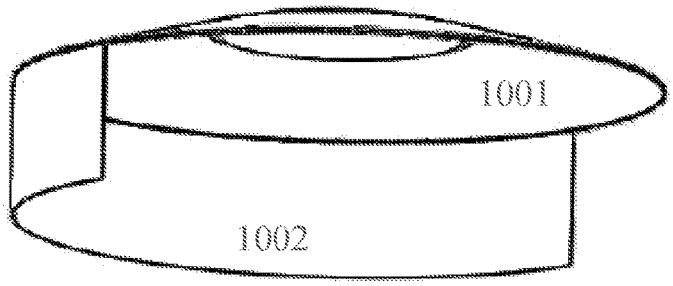
FIG. 10 is an integrated cap and heat shield in an embodiment.

FIG. 10 is an integrated cap and heat shield in an embodiment. The existing overhead reflector cap 105 above the burner may be replaced with a reflector 1001 that has a built-in directional focusing shield 1002. The directional section 1002 of the shield comprises a curved sheet of reflective metal that is either fixed in place via weld/fastener or capable of sliding around the circumference of the top circular section 1001 of the reflector. This embodiment can either be sold as a retrofit replacement for the overhead heat shield of a prior art patio heater or it may be sold as existing feature of a heater.

Figure 11:
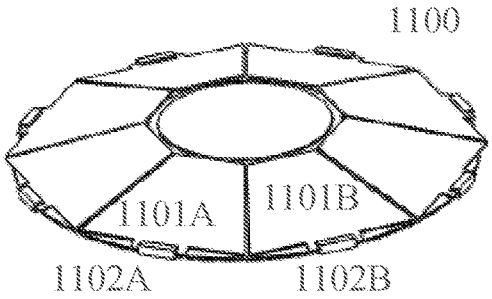
FIG. 11 illustrates a top view of an embodiment of a combined cap and heat shield.

FIG. 11 illustrates a top view of an embodiment of a combined cap and heat shield. The heat shield comprises a cap 1100 that serves the same function as cap 105 of an existing heater. In this embodiment, there are a plurality of wedge shaped sections such as sections 1101A and 1101B that are coupled to the cap 1110 via hinged members 1102A and 1102B. The wedged shaped sections are formed around the circumference of the cap 1100 as shown.

Figure 12:
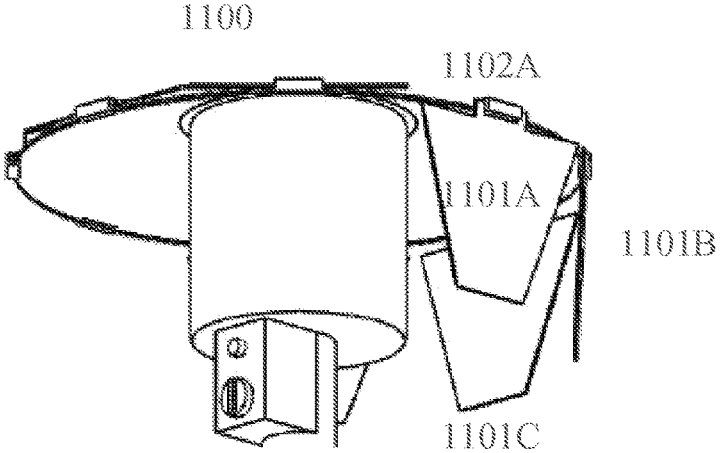
FIG. 12 illustrates the operation of the heat shield of FIG. 11.

The operation of the shield 1100 is illustrated in FIG. 12. When desired, a user can swing one or more wedge shaped sections down to form a directional heat shield. In the example shown, sections 1101A, 1101B (shown in profile), and 1101C are flipped down to form a directional heat shield. This embodiment allows the user to direct the heat in a customized fashion by selecting the number and location of the sections to flip down.

Figure 13:
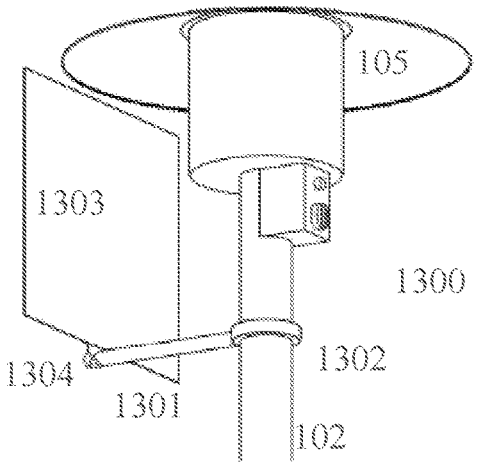
FIG. 13 illustrates an embodiment of a directional heat shield.

FIG. 13 illustrates an embodiment of a directional heat shield assembly 1300. An arm or boom-stand style linkage 1301 is attached via collar 1302 to the heater such as on the shaft 102 that leads up to the burner. The arm 1301 suspends a heat shield 1303 that can either be flat or curved to match the circular overhead cap/reflector 105. The shield 1303 is coupled to the arm 1301 via fastener 1304. The arm 1301 may be rotated around the shaft 102 to direct heat in different directions as desired.

Figure 14:
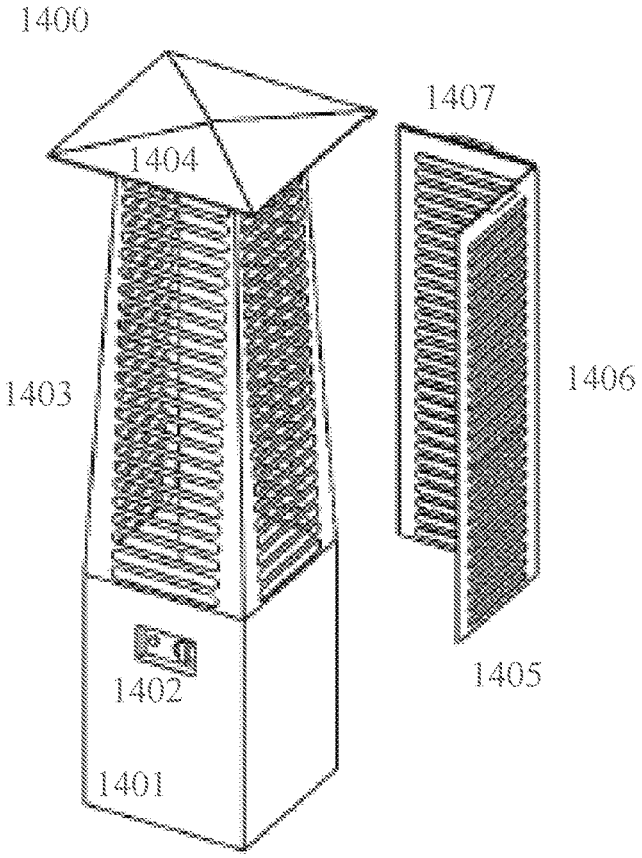
FIG. 14 illustrates a directional heat shield with a vortex style heater.

FIG. 14 illustrates a directional heat shield for use with a vortex or pyramid style heater. A vortex or pyramid flame style heater 1400 comprises a base 1401, control unit 1402, pyramid structure 1403, and reflector cap 1404. The fuel source (e.g. propane) is kept in the base 1401 and is activated and ignited via control unit 1402. The fuel is emitted into a clear tube (e.g. glass, not shown) that extends through the middle of the pyramid structure 1403. The heater 1400 is topped by a reflector cap 1404. In operation, a flame extends through some or all of the length of the glass tube when lit, providing heat that is radiated away from the heater in all directions.

Vortex or pyramid type heaters are known for poor performance when compared to round heaters because much of the heat radiance is traded for the aesthetic appeal of the open and visible flame. In one embodiment, a one, two, or three panel directional heat shield 1405 is provided that matches the dimensions of the side walls of the pyramid structure 1403. In one embodiment, the heat shield 1405 includes ribbed sections 1406 and fasteners 1407. The heat shield 1405 may be attached to the edge of the cap 1404 in one embodiment. In one embodiment, the heat shield 1405 may be coupled to the heater 1400 directly overlaying the sides of the pyramid structure 1403. The use of the heat shield 1405 can improve the heating performance of the vortex heater 1400 such that it can approximate the ability of a round heater.

Figure 15:
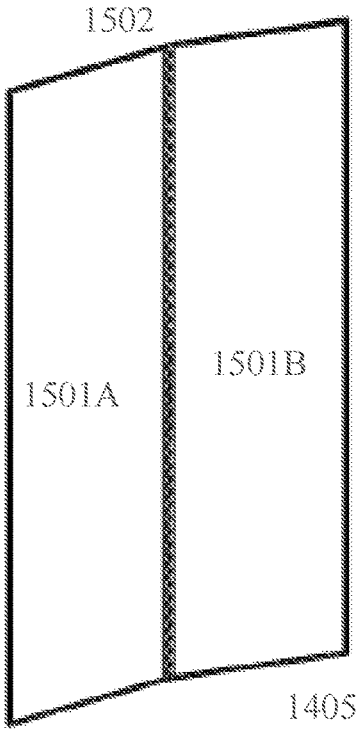
FIG. 15 is a detailed view of the heat shield of FIG. 14.

FIG. 15 illustrates the directional heat shield of FIG. 14. The heat shield 1405 may be ribbed or flat as desired. It may be individual panels shaped like each side of the pyramid structure or it may be a pair of panels 1501A and 1501B joined by hinge 1502. The panels may be metal or heat resistant fabric as desired.

In one embodiment, the system may use high heat fabric or foam to add insulative properties to the directional heat shield, further reducing the spread of heat in the direction of the heat shield and increasing heat distribution in the desired direction.

Thus, a directional heat shield has been described.

What is claimed is:

1. A directional heat shield for use with an existing heater having a cap over a heating element, the heat shield comprising:

a plurality of heat reflective panels each separately hingedly coupled to and disposed along a full circumference of an outer edge of the cap and movably positioned from resting atop the cap to hanging vertically from the outer edge of the cap;

selecting one or more of the panels to be disposed vertically to customizably create a desired reflective surface.

* * * * *